US007506713B2

(12) United States Patent
Miura et al.

(10) Patent No.: US 7,506,713 B2
(45) Date of Patent: Mar. 24, 2009

(54) HEAT EXCHANGER FOR MOTORCYCLE USE AND MANUFACTURING METHOD THEREOF

(75) Inventors: Shinya Miura, Kariya (JP); Yoshihiro Tajima, Anjo (JP)

(73) Assignee: Denso Corporation, Kariya (JP)

( * ) Notice: Subject to any disclaimer, the term of this patent is extended or adjusted under 35 U.S.C. 154(b) by 49 days.

(21) Appl. No.: 11/726,295

(22) Filed: Mar. 21, 2007

(65) Prior Publication Data

US 2007/0221368 A1 Sep. 27, 2007

(30) Foreign Application Priority Data

Mar. 27, 2006 (JP) ..... 2006-084608

(51) Int. Cl.
*B60K 11/04* (2006.01)

(52) U.S. Cl. ..... 180/68.4; 180/229

(58) Field of Classification Search ..... 180/68.3, 180/68.4, 68.6, 229
See application file for complete search history.

(56) References Cited

U.S. PATENT DOCUMENTS 4,570,740 A * 2/1986 Hara ..... 180/229
5,267,624 A * 12/1993 Christensen ..... 180/68.2
5,992,554 A * 11/1999 Hasumi et al. ..... 180/229
6,332,505 B1 * 12/2001 Tateshima et al. ..... 180/229
6,695,089 B2 * 2/2004 Adachi et al. ..... 180/311
6,971,438 B2 * 12/2005 Oki et al. ..... 165/41
7,159,682 B2 * 1/2007 Arnold ..... 180/229
7,377,350 B2 * 5/2008 Gokan et al. ..... 180/229
2006/0076177 A1 * 4/2006 Arnold ..... 180/219
2007/0246279 A1 * 10/2007 Miura ..... 180/68.4

FOREIGN PATENT DOCUMENTS

JP 02-306890 12/1990
JP 2001-1970 1/2001

* cited by examiner

*Primary Examiner*—Toan C To
(74) *Attorney, Agent, or Firm*—Harness, Dickey & Pierce, PLC

(57) ABSTRACT

A heat exchanger, for motorcycle use and mounted on a motorcycle and in which heat is exchanged between air and a heating medium flowing inside the heat exchanger, is characterized in that: the heat exchanger is fixed to a motorcycle body via a bracket 8; the bracket 8 includes a through-hole 80 into which a portion of the motorcycle body is inserted via a cylindrical grommet 9 and collar 10 capable of being elastically deformed; a cylindrical burring portion 81, which protrudes onto one side, is formed in an inner circumferential edge portion 80*a* of the through-hole 80; the grommet 9 is inserted into the through-hole 80 so that the grommet 9 can be contacted with the inner circumferential edge portion 80*a* of the through-hole 80; and a forward end portion of the burring portion 81 is directed outside in the radial direction with respect to the inner circumferential edge portion 80*a* of the through-hole 80.

4 Claims, 6 Drawing Sheets

HEAT EXCHANGER FOR MOTORCYCLE USE AND MANUFACTURING METHOD THEREOF

BACKGROUND OF THE INVENTION

1. Field of the Invention

The present invention is related to a heat exchanger mounted on a motorcycle and to a manufacturing method thereof. The present invention is effectively applied to a radiator, for motorcycle use, for cooling cooling water circulated in an internal combustion engine.

2. Description of the Related Art

FIG. 1 is a front view showing a conventional radiator 1 for motorcycle use. Usually, the radiator 1 includes tubes 2, fins 3, header tanks 4 and so forth. Concerning the structure of the conventional radiator, refer to the official gazette of JP-A-2001-1970.

In this connection, the radiator is conventionally fixed to a vehicle as follows. A through-hole is formed in a bracket provided in the radiator. After a rubber grommet and a collar have been attached to the through-hole, a frame of the vehicle is engaged in the through-hole via the grommet and collar so that the radiator can be fixed to the vehicle.

In the case of a motorcycle used for motocross racing which requires a high vibration-proof property, as shown in FIG. 7, a burring portion J81 is formed in an inner circumferential edge portion J80*a* of a through-hole J80 by the working of burring, so that a contact area of the grommet J9 with the inner circumferential portion J80*a* of the through-hole J80 can be magnified and the vibration-proof property can be enhanced.

However, in the above radiator for motorcycle use which is used for motocross racing, the following problems may be encountered. At the time of forming the burring portion J81, as shown in FIG. 8, a forward end portion J81*a* of the burring portion J81 is ironed by the working of burring and formed into a sharp shape. Therefore, when the burring portion J81 and the grommet J9 are rubbed with each other, the sharp forward end portion J81*a* shaves the grommet J9. Accordingly, there is a possibility that the grommet J9 is ruptured. When the grommet J9 is ruptured, high intensity vibration is transmitted from the vehicle to the radiator. Accordingly, there is a possibility that the radiator may be broken.

SUMMARY OF THE INVENTION

The present invention has been accomplished in view of the above points. It is an object of the present invention is to provide a heat exchanger for motorcycle use in which a grommet used at the time of attaching the heat exchanger to a vehicle can be prevented from being ruptured.

In order to accomplish the above object, an aspect of the present invention provides a heat exchanger for motorcycle use mounted on a motorcycle in which heat is exchanged between air and a heating medium flowing inside the heat exchanger, wherein: the heat exchanger is fixed to a motorcycle body via a fixing member (8); the fixing member (8) includes a through-hole (80) into which a portion of the motorcycle body is inserted via a cylindrical grommet (9) capable of being elastically deformed and a collar (10); a cylindrical burring portion (81), which protrudes onto one side, is formed in an inner circumferential edge portion (80*a*) of the through-hole (80); the grommet (9) is inserted into the through-hole (80) so that the grommet (9) can be contacted with the inner circumferential edge portion (80*a*) of the through-hole (80); and a forward end portion of the burring portion (81) is directed outside in the radial direction with respect to the inner circumferential edge portion (80*a*) of the through-hole (80).

In this case, "a portion of the motorcycle body" is not limited to a component integrated with the motorcycle body but includes a component that is provided separately and fixed to the motorcycle body by a bolt and so on.

Due to the above structure, even when the burring portion (81) and the grommet (9) rub against each other, it is possible to avoid contact between the forward end portion of the burring portion (81) and the grommet (9). Therefore, even if a sharp portion is generated in the forward end portion of the burring portion (81), the sharp portion does not come into contact with the grommet (9). Therefore, it is possible to prevent the grommet (9) from being ruptured.

In this case, when the forward end portion of the burring portion (81) is pressed from one side to the other side, it can be directed outside in the radial direction of the through-hole (80).

Due to the foregoing, it is unnecessary to add new parts for preventing the grommet (9) from being ruptured. Therefore, it is possible to maintain the number of parts to be the same as that of the conventional structure. Further, as it is sufficient to add a relatively easy working method of pressing the burring portion (81), it is possible to suppress a deterioration in the productivity. At the same time, it is possible to prevent an increase in the number of manufacturing steps by more than one.

Another aspect of the present invention provides a method of manufacturing a heat exchanger for motorcycle use, mounted on a motorcycle, in which heat is exchanged between air and a heating medium flowing inside the heat exchanger, comprising: a first step in which a through-hole (80), into which a portion of a motorcycle body is inserted via a cylindrical grommet (9) capable of being elastically deformed, is formed when burring is conducted on a fixing member (8) for fixing the motorcycle body and in which a cylindrical burring portion (81) protruding onto one side is formed in an inner circumferential edge portion (80*a*) of the through-hole (80); and a second step in which a forward end portion of the burring portion (81) is directed outside in the radial direction of the through-hole (80) when the forward end portion of the burring portion (81) is pressed from one side to the other side by a pressing member (P), an end portion opposed to the forward end portion of the burring portion (81) of which is tapered.

Due to the foregoing, and when only a relatively simple working method of pressing the burring portion (81) is added, it is possible to prevent the grommet (9) from being ruptured.

In this connection, reference numerals in the parentheses of each means described above correspond to the specific means described in the embodiment described later.

The present invention may be more fully understood from the description of preferred embodiments of the invention, as set forth below, together with the accompanying drawings.

BRIEF DESCRIPTION OF THE DRAWINGS

In the drawings:

FIG. 6A is a sectional view showing a comparative example, wherein FIG. 6A shows a state before assembling;

FIG. 6B is a sectional view showing a comparative example, wherein FIG. 6B shows a state after assembling;

DESCRIPTION OF THE PREFERRED EMBODIMENTS

Figure 1:
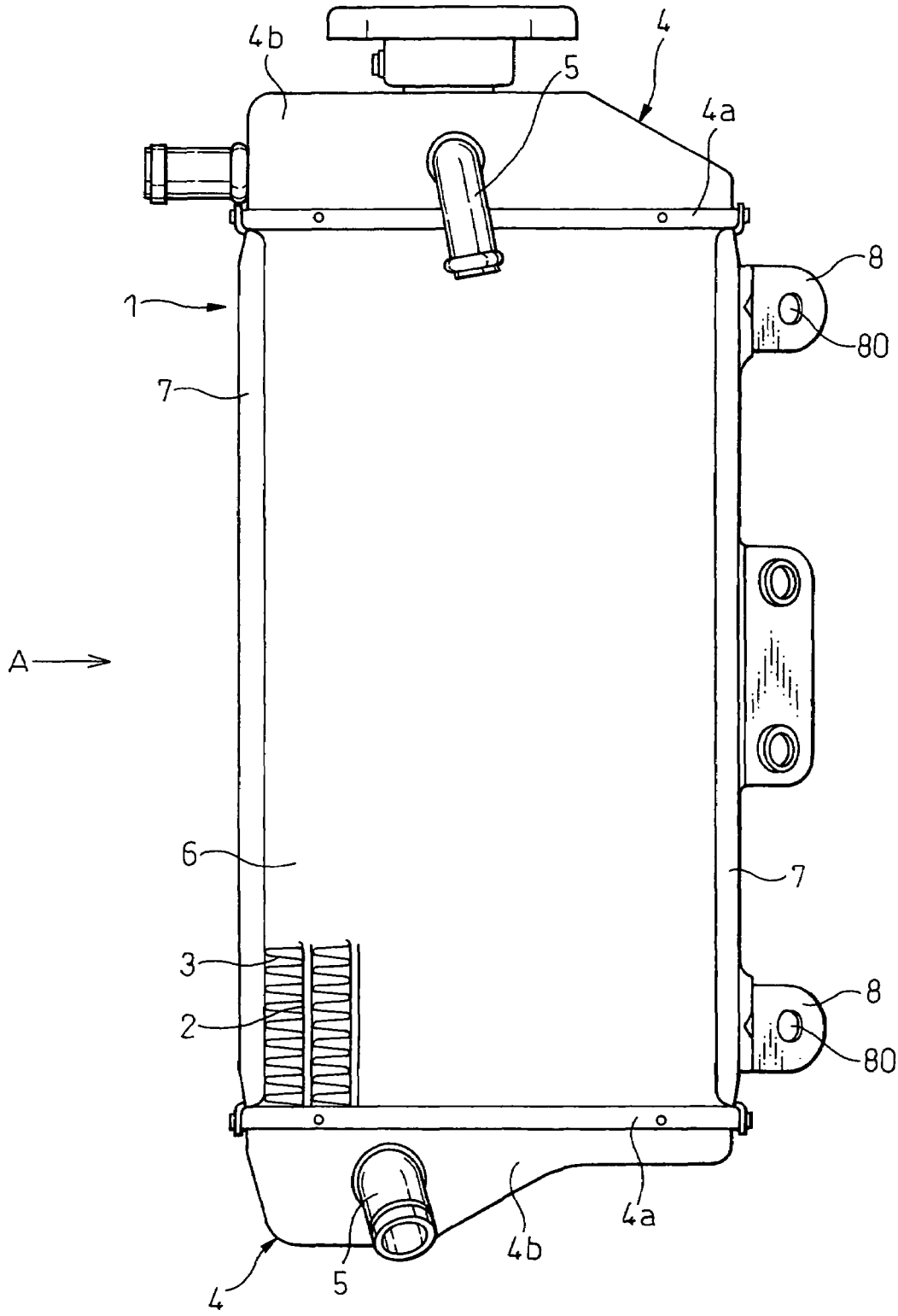
Fig.1 PRIOR ART
FIG. 1 is a front view showing a radiator 1 of an embodiment of the present invention.

Referring to FIGS. 1 to 5, an embodiment of the present invention will be explained below. In this embodiment, the present invention is applied to a radiator 1 mounted on a motorcycle used for motocross racing. As shown in FIG. 1, a front view showing appearance of the radiator 1 of this embodiment is the same as that of the conventional radiator.

Specifically, the radiator 1 includes: a plurality of tubes 2 in which cooling water (a heating medium) is circulated; corrugated fins 3 joined onto outer surfaces of the tubes 2; header tanks 4 provided on both sides in the longitudinal direction of the tubes 2, communicated with the plurality of tubes 2; and connection pipes 5 connected to the header tanks 4 and also connected to outer pipes. In this embodiment, all parts composing the radiator 1 such as tubes 2, fins 3, header tanks 4 and connection pipes 5 are made of aluminum alloy. These parts are integrally joined to each other by means of brazing. In this connection, a substantially rectangular heat exchanging portion, which is formed out of the tubes 2 and the fins 3, is referred to as a core portion 6.

The header tanks 4 extend in a direction perpendicular to the longitudinal direction of the tubes 2 at the end portions in the longitudinal direction of the tubes 2 and communicate with the plurality of tubes 2. Each header tank 4 includes: a core plate 4*a* into which the tubes 2 are inserted and joined; and a tank body 4*b* composing a tank space together with the core plate 4*a*. In this connection, the header tank 4 arranged on an upper side on the surface of the drawing distributes and supplies the cooling water to the tubes 2. The header tank 4 arranged on a lower side on the surface of the drawing collects and recovers the cooling water which has completed a heat exchange.

At both end portions of the core portion 6, inserts 7 are provided which extend substantially parallel with the longitudinal direction of the tubes 2 so as to reinforce the core portion 6. To each insert 7, a bracket (fixing member) 8 for fixing the radiator 1 to a vehicle frame (not shown) or cowl is fixed.

Figure 2:
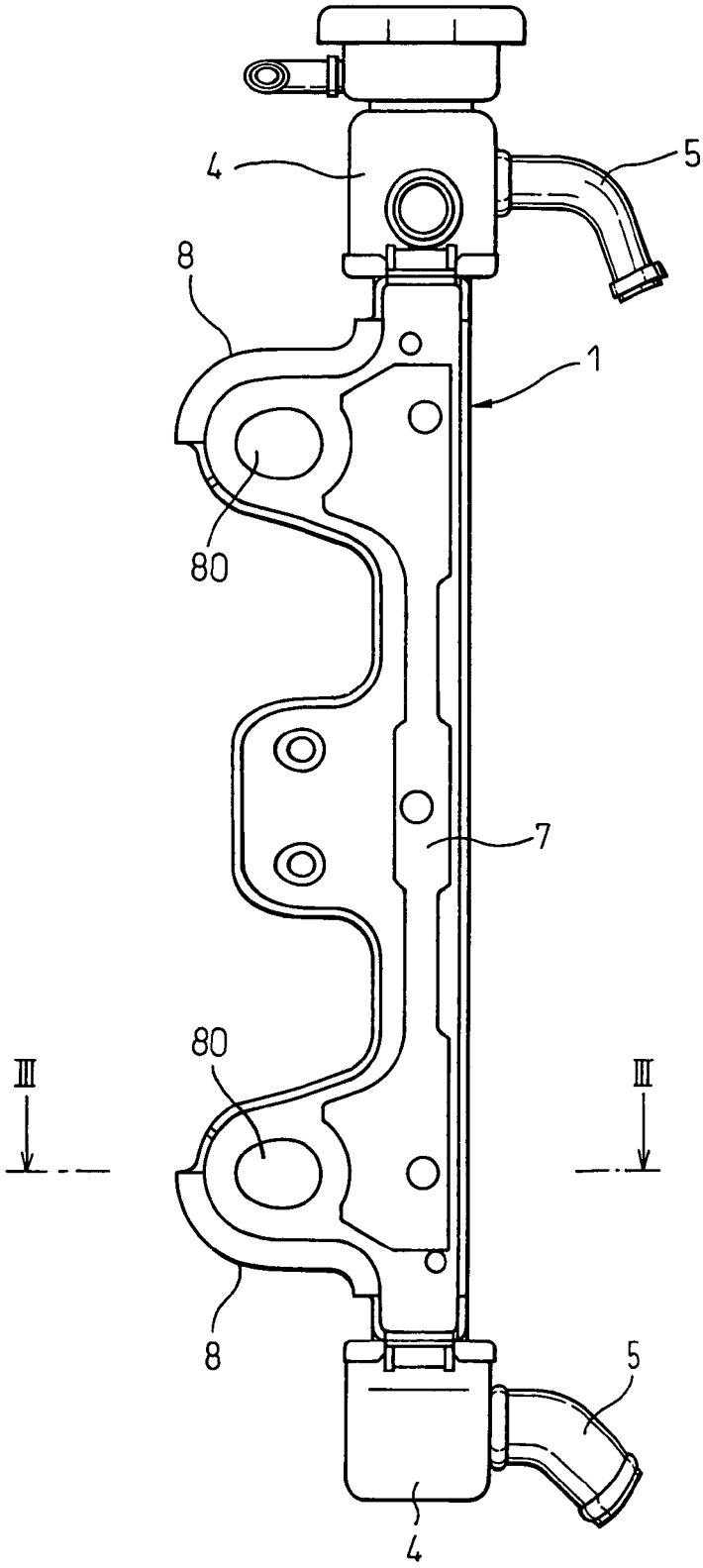
FIG. 2 is a view taken in a direction of arrow A in FIG. 1.
Figure 3:
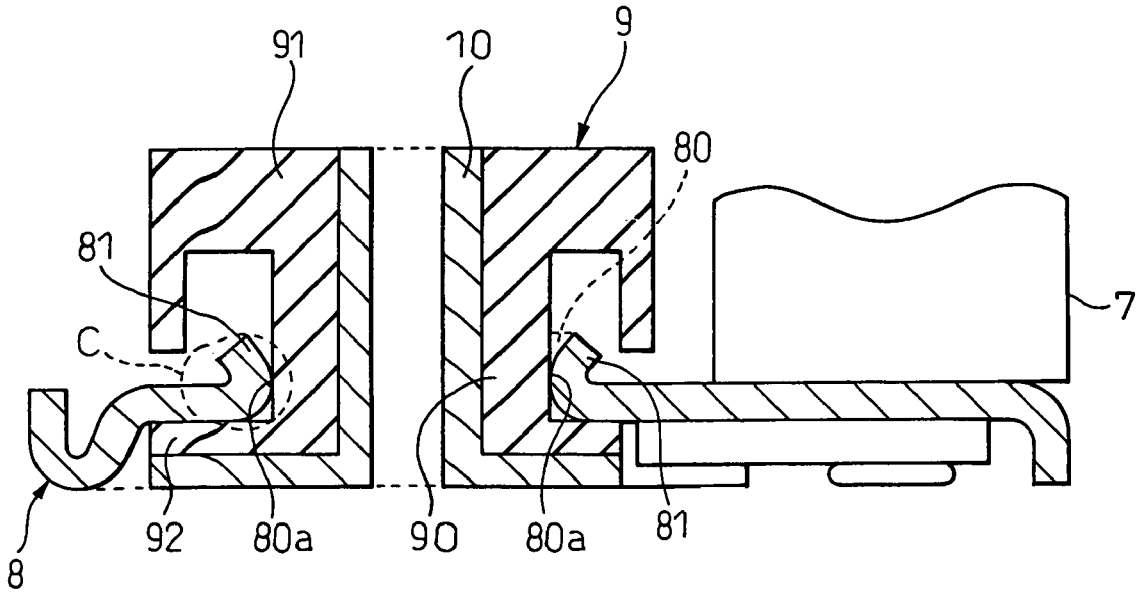
FIG. 3 is a sectional view taken on line III-III in FIG. 2.

FIG. 2 is a view taken in the direction of arrow A in FIG. 1. FIG. 3 is a sectional view taken on line III-III in FIG. 2. As shown in FIGS. 2 and 3, the bracket 8 includes through-holes 80 into which a portion of the vehicle frame (not shown) is inserted. In an inner circumferential edge portion 80*a* of each through-hole 80, a cylindrical burring portion 81 is formed by the working of burring in such a manner that the burring portion 81 protrudes inside in the lamination direction of the tube 2 of the radiator 1.

As shown in FIG. 3, the grommet 9 includes: a cylindrical portion 90 extending so that the cylindrical portion 90 can penetrate the through-hole 80; a first flange portion 91 extending disk-like from an outer face of the cylindrical portion 90; and a second flange portion 92 extending disk-like from an outer face of the cylindrical portion 90. In this connection, concerning both flange portions 91, 92, the flange portion, which extends on the inside face in the lamination direction of the tube 2 of the bracket 8, is the first flange portion 91 and the flange portion, which extends on the outside face in the lamination direction of the tube 2 of the bracket 8, is the second flange portion 92.

The grommet 9 is engaged with the through-hole 80 under the condition that a periphery of the through-hole 80 is interposed between both flange portions 91, 92. At this time, a cylindrical portion 90 of the grommet 9 comes into contact with the inner circumferential portion 80*a* of the through-hole 80. The grommet 9 is made of material which can be elastically deformed. In the present embodiment, the grommet 9 is made of rubber. In order to absorb vibration, the grommet 9 has a buffer function. A metallic color 10 is applied to the grommet 9.

Figure 4:
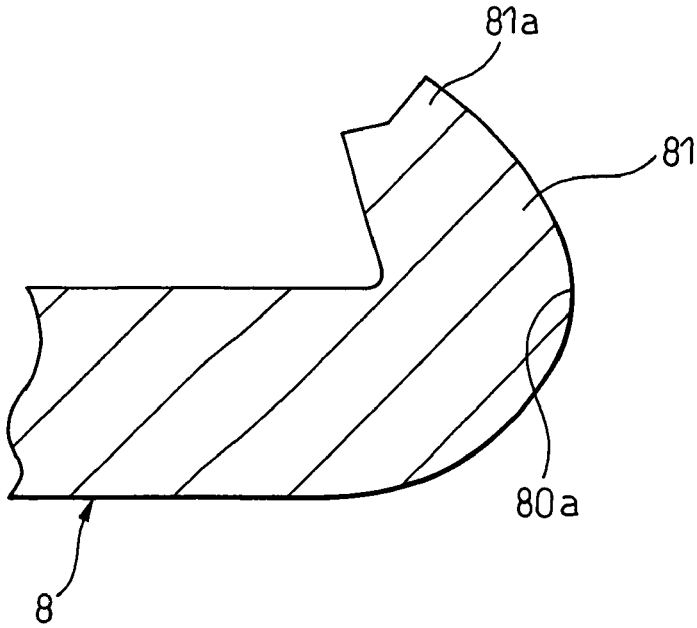
FIG. 4 is an enlarged view of portion C in FIG. 3.

FIG. 4 is an enlarged view of portion C in FIG. 3. As shown in FIG. 4, a forward end side of the burring portion 81 is squashed. Therefore, a forward end portion 81*a* is directed outside in the radial direction with respect to the inner circumferential edge portion 80*a* of the through-hole 80. This will form a space between an inner circumferential surface of foward end portion 81*a* and an outer circumferential surface of cylindrical portion 90 as shown in FIG. 3.

Figure 5A:
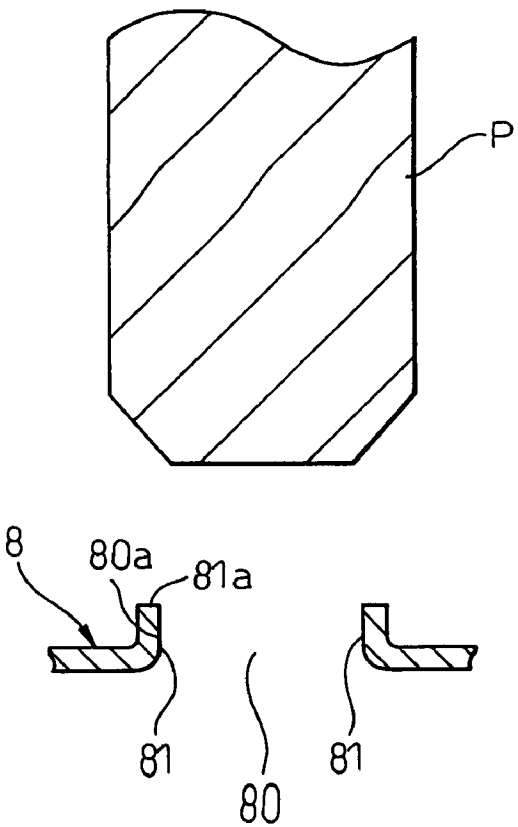
FIGS. 5A-5C are a process drawing showing an order of working of working a through hole 80 in an embodiment of the present invention.
Figure 5B:
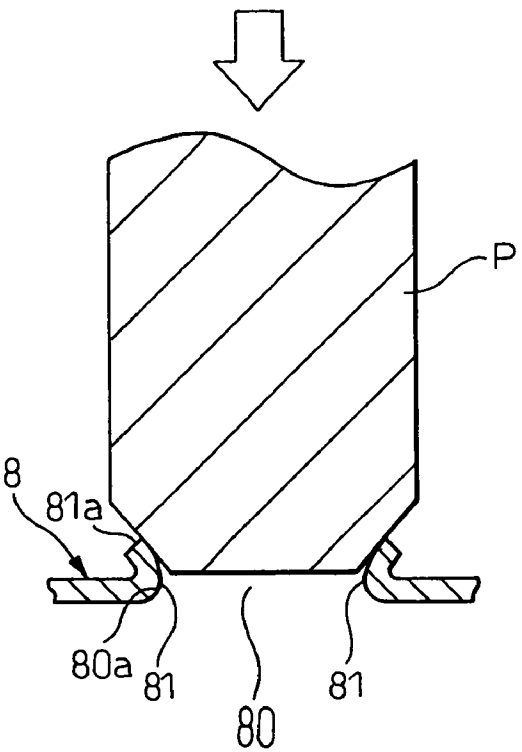
Figure 5C:
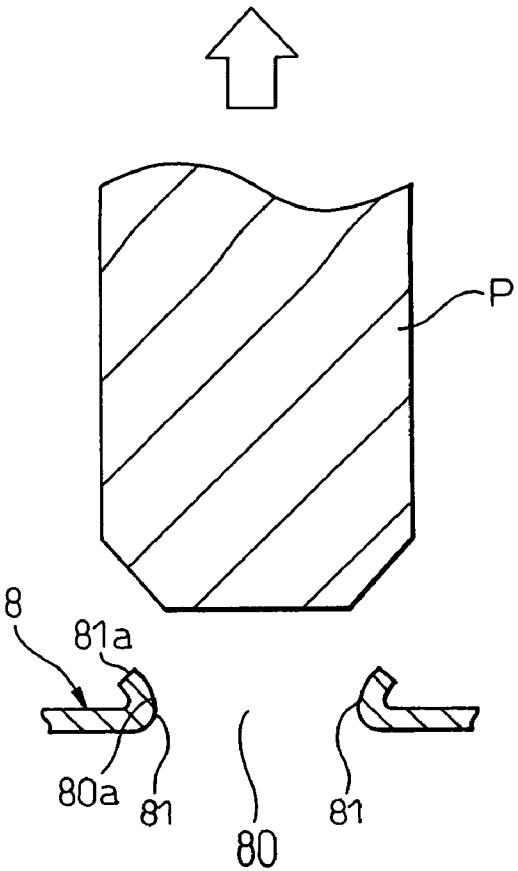

Next, a method of working the through-hole 80 of the bracket 8 in the present embodiment will be explained by referring to FIGS. 5A-5C. FIGS. 5A-5C are a process drawing showing an order of the working of the through-hole 80 in the present embodiment.

First, when the working of burring is conducted on the bracket 8, the through-hole 80 is formed and the burring portion 81 is formed in the inner circumferential edge portion 80*a* of the through-hole 80. Concerning the working of burring, refer to JIS (Japanese Industrial Standard) B0122. At this time, the burring portion 81 protrudes onto one side (upper side on the surface of the drawing). In this case, a forward end portion 81*a* of the burring portion 81 is sharp, that is, the thickness of the burring portion 81 is reduced when it comes to the forward end side.

Next, the burring portion 81 is subjected to the working of punching. As shown in FIG. 5A, a punch (pressing member) P is prepared in which a diameter is larger than that of the through-hole 80 and in which an end portion of the punch, which is opposed to the forward end portion 81*a* of the burring portion 81, is tapered. As shown in FIG. 5B, the forward end portion 81*a* of the burring portion 81 is pressed from one side to the other side by this punch P. Due to this pressing action, as shown in FIG. 5C, the burring portion 81 is squashed in the axial direction. Therefore, the forward end portion 81*a* of the burring portion 81 is directed outside in the radial direction.

As explained above, when the burring portion 81 is pressed from one side (upper side on the surface of the drawing) to the other side (lower side on the surface of the drawing) so that the forward end portion 81*a* of the burring portion 81 can be directed outside in the radial direction with respect to the inner circumferential edge portion 80*a*, even when the burring portion 81 and the cylindrical portion 90 of the grommet 9 are rubbed with each other, it is possible to avoid a contact of the sharp forward end portion 81*a* of the burring portion 81 with the cylindrical portion 90 of the grommet 9. Therefore, it is possible to prevent the grommet 9 from being ruptured.

Figure 6B:
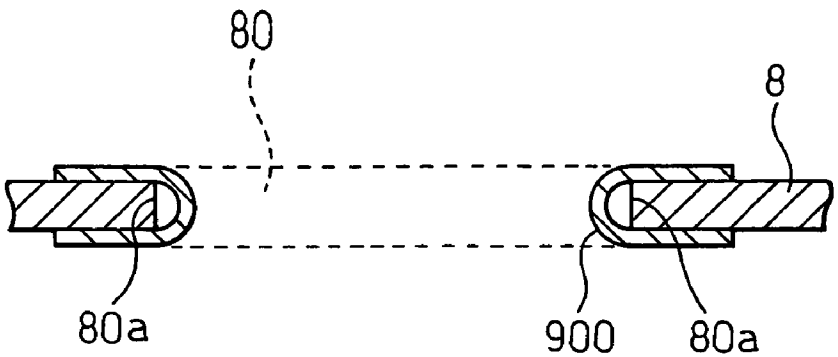
Figure 6A:
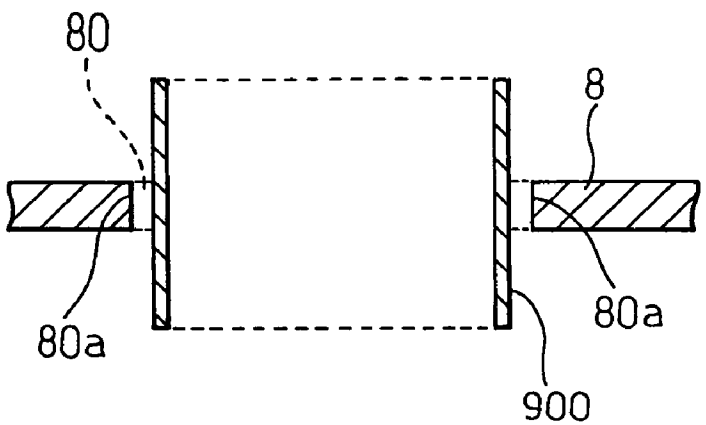
Figure 7:
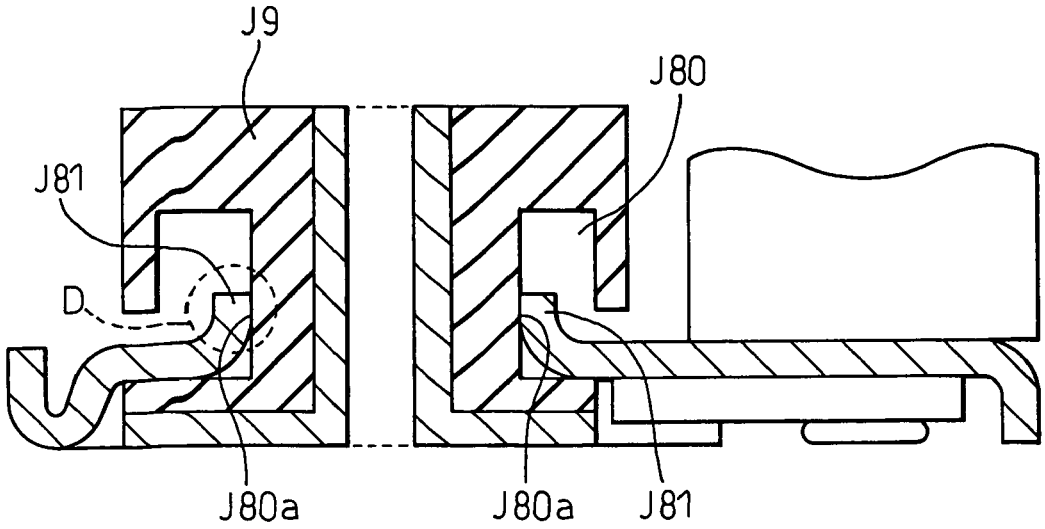
Fig.7 PRIOR ART
FIG. 7 is an enlarged sectional view showing a primary portion of a conventional heat exchanger.
Figure 8:
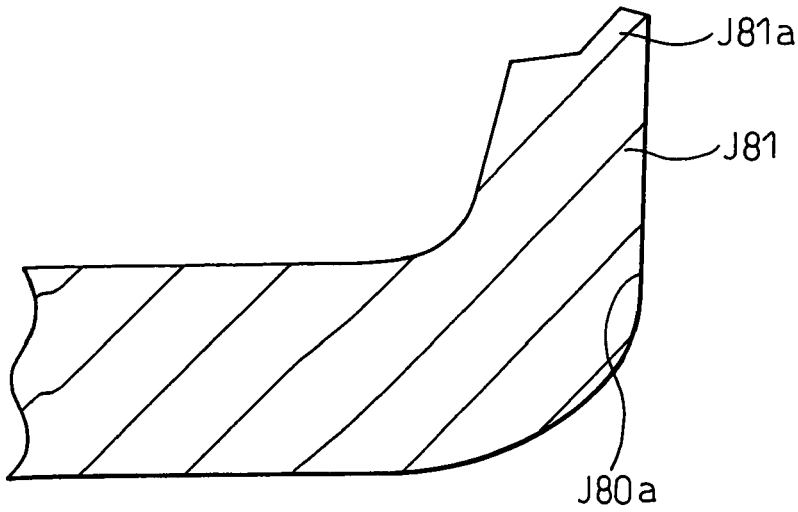
Fig.8 PRIOR ART
FIG. 8 is an enlarged view showing portion D in FIG. 7.

In this connection, FIGS. 6A and 6B are views showing a comparative example. In this comparative example, the working of burring is not conducted on the through-hole 80. Instead of that, a cover member 900 is added. In the comparative example shown in FIGS. 6A and 6B, after the cylindrical cover member 900 has been inserted into the through-hole 80 as shown in FIG. 6A, the cover member 900 is bent so as to cover the inner circumferential edge portion 80*a* of the through-hole 80 as shown in FIG. 6B.

In this case, it is necessary to newly add a cover member 900. Therefore, the number of parts is increased as compared with the number of parts of the present embodiment. Further, it is necessary to work the cylindrical cover member 900 into a shape so that it can cover the inner circumferential edge portion 80*a* of the through-hole 80. Therefore, as compared with the present embodiment, the number of manufacturing steps is increased. Further, it is difficult to temporarily fix the cover member 900 to the inner circumferential edge portion 80*a* of the through-hole 80. Accordingly, it is difficult to integrate both of them into one body by means of brazing. Accordingly, the productivity is deteriorated as compared with that of the present embodiment.

On the other hand, according to the present embodiment, it is unnecessary to add new parts. Therefore, the number of parts can be made to be the same as that of the conventional structure. Further, it is sufficient to add the working of punching (the working of pressing the burring portion 81 from the forward end side) which is a relatively easy working method. Accordingly, it is possible to prevent a deterioration in productivity. Further, an increase in the number of manufacturing steps can be suppressed to only one.

In this connection, the motorcycle explained in the above embodiment is used for motocross racing. However, it should be noted that the motorcycle is not limited to a motorcycle for the above specific use. The present invention may be applied to a motorcycle used for touring.

In the above embodiment, the heat exchanger for motorcycle use is applied to the radiator 1. However, it should be noted that the present invention is not limited to the above specific use. The present invention may be applied to other coolers.

While the invention has been described by reference to specific embodiments chosen for purposes of illustration, it should be apparent that numerous modifications could be made thereto by those skilled in the art without departing from the basic concept and scope of the invention.

The invention claimed is:

1. A heat exchanger for motorcycle use mounted on a motorcycle in which heat is exchanged between air and a heating medium flowing inside the heat exchanger, wherein the heat exchanger is fixed to a motorcycle body via a fixing member;

the fixing member includes a through-hole into which a portion of the motorcycle body is inserted via a cylindrical grommet capable of being elastically deformed and a collar;

a cylindrical burring portion, which protrudes onto one side, is formed in an inner circumferential edge portion of the through-hole;

the grommet is inserted into the through-hole so that the grommet contacts with the inner circumferential edge portion of the through-hole; and a forward end portion of the burring portion is directed outward in the radial direction with respect to the inner circumferential edge portion of the through-hole to avoid contact between an inner circumferential surface of the forward end portion of the burring portion with a cylindrical portion of the grommet.

2. A heat exchanger for motorcycle use according to claim 1, wherein the forward end portion of the burring portion is directed outside in the radial direction of the through-hole when the forward end portion of the burring portion is pressed from one side to the other side.

3. A method of manufacturing a heat exchanger for motorcycle use, mounted on a motorcycle, in which heat is exchanged between air and a heating medium flowing inside the heat exchanger, comprising:

a first step in which a through-hole, into which a portion of a motorcycle body is inserted via a cylindrical grommet capable of being elastically deformed, is formed when burring is conducted on a fixing member for fixing the motorcycle body and in which a cylindrical burring portion protruding onto one side is formed in an inner circumferential edge portion of the through-hole; and a second step in which a forward end portion of the burring portion is directed outside in the radial direction of the through-hole when the forward end portion of the burring portion is pressed from one side to the other side by a pressing member (P), an end portion opposed to the forward end portion of the burring portion of which is tapered.

4. A heat exchanger for a motorcycle, the heat exchanger comprising:

a heat exchanging portion;

a fixing member for fixing the heat exchanger to the motorcycle, the fixing member comprising:

a cylindrical burring portion extending from a wall of the fixing member, the cylindrical burring portion defining a through-hole;

a cylindrical elastomeric grommet disposed within the through-hole, an outer circumferential surface of a cylindrical portion of the cylindrical elastomeric grommet contacting an inner circumferential surface of the cylindrical burring portion;

a forward end portion of the cylindrical burring portion spaced from the wall of the fixing member defining a space between the inner circumferential surface of the cylindrical burring portion and the outer circumferential surface of the cylindrical portion of the cylindrical elastomeric grommet.

* * * * *